US007237654B2

(12) United States Patent
Sakura et al.

(10) Patent No.: US 7,237,654 B2
(45) Date of Patent: Jul. 3, 2007

(54) LIFTER DEVICE

(75) Inventors: Shunji Sakura, Osaka (JP); Hiroki Ishida, Osaka (JP); Shiro Inoue, Osaka (JP); Takayuki Morimoto, Osaka (JP)

(73) Assignee: Tsubakimoto Chain Co., Osaka (JP)

( * ) Notice: Subject to any disclaimer, the term of this patent is extended or adjusted under 35 U.S.C. 154(b) by 0 days.

(21) Appl. No.: 11/374,543

(22) Filed: Mar. 11, 2006

(65) Prior Publication Data

US 2006/0249356 A1 Nov. 9, 2006

(30) Foreign Application Priority Data

Apr. 12, 2005 (JP) ..... 2005-114482

(51) Int. Cl.
*B66B 9/02* (2006.01)

(52) U.S. Cl. ..... 187/270

(58) Field of Classification Search ..... 198/750.1, 198/801; 187/270; 414/531; 74/89.2, 89.21
See application file for complete search history.

(56) References Cited

U.S. PATENT DOCUMENTS

| | | | | |
|---|---|---|---|---|
| 1,746,109 | A * | 2/1930 | Edwards | 114/370 |
| 3,724,644 | A * | 4/1973 | Reimers | 198/803.13 |
| 4,180,154 | A * | 12/1979 | Andersson | 198/419.3 |
| 4,753,119 | A * | 6/1988 | Kuspert | 74/89.21 |
| 5,056,278 | A * | 10/1991 | Atsukawa | 52/108 |
| 5,103,686 | A * | 4/1992 | Rosenquist | 74/89.2 |
| 5,558,181 | A * | 9/1996 | Bundo | 187/270 |
| 5,951,239 | A * | 9/1999 | Averill et al. | 414/801 |
| 6,279,732 | B1 * | 8/2001 | Thompson | 198/799 |
| 6,820,369 | B2 * | 11/2004 | Fenelon | 49/349 |
| 6,840,368 | B2 * | 1/2005 | Betti et al. | 198/347.3 |
| 7,014,360 | B2 * | 3/2006 | Stenfors | 378/195 |
| 7,128,226 | B2 * | 10/2006 | Assmann | 212/273 |

FOREIGN PATENT DOCUMENTS

| | | |
|---|---|---|
| JP | 09-119495 | 5/1997 |
| JP | 09-165196 | 6/1997 |

* cited by examiner

*Primary Examiner*—Douglas Hess
(74) *Attorney, Agent, or Firm*—Woodling, Krost, & Rust

(57) ABSTRACT

To provide a compact lifter device, which can attain a work-piece's lifting/lowering operation in a stable supporting state and can reduce the parts number and an assembly load. A lifter device 100 in which a pair of work-piece lifting chains 130, 130 respectively fed movably forward and backward by a pair of regularly/reversely rotatable driving sprockets 120, 120 while being sandwiched by the sprockets includes flexing suppression members 140, 140 disposed oppositely to each other, and each of these flexing suppression members 140, 140 comprises a number of blocks 141 disposed at mounting intervals of two times the chain pitch P on a drawing side of the work-piece lifting/lowering chain 130 and a lifting/lowering support bar 142 of a length corresponding to a chain's upright state, disposed on a feeding side continued to the drawing side of the work-piece lifting/lowering chain 130, so that the flexing suppression members 140, 140 are engaged with each other to lift or lower a work-piece in a chain's upright state of the fed chain.

5 Claims, 6 Drawing Sheets

LIFTER DEVICE

This patent application claims priority to Japanese Patent Application No. 2005-114482 filed Apr. 12, 2005.

TECHNICAL FIELD

The present invention relates to a lifter device, in which flexing suppression members respectively provided in a pair of work-piece lifting/lowering chains are engaged with each other so that a work-piece is lifted or lowered in a chain's upright state.

BACKGROUND TECHNOLOGY

As a lifter device, which lifts or lowers a work-piece in a chain's upright state with lifting/lowering chains, an elongated feed device for a band body, which successfully performs the feeding of opposed chains and in which a stop position of an operating portion during a power cutting or the like can be maintained in an accurate and simple configuration, has been known (see Japanese Patent Reference 1).

Further, as another lifter device, a feed device for band bodies, which accommodates adjacent band bodies in a compact manner so as to be able to feed the band bodies without making into contact with each other, and can be miniaturized while sufficiently forming the length of an operation portion (see Japanese Patent Reference 2).

Patent Reference 1 is Japanese Laid-Open Patent Publication No. Hei. 9-119495.

Patent Reference 2 is Japanese Laid-Open Patent Publication No. Hei. 9-165196.

Problems to be Solved by the Invention

However, since in the former elongated feed device, a winding angle with respect to a driving sprocket for a chain fed in an elongated manner is 90° or more, there was a problem that an accommodating space for the chain in an elongated feed device cannot be miniaturized. Additionally, since oppositely-connected block-shaped control members serve as a columnar operating portion having rigidity during the feed of the chain, there was a problem that the parts number is increased and significant incorporation manpower is needed, and when a member to be operated is a heavy lift or when feeding of an elongated member is performed at high speed, the member to be operated cannot be sufficiently supported, resulted in a unstable elongated feed state.

Further, since in the latter feed device, control members serve as a columnar operating portion having rigidity, there was a problem that when a member to be operated is a heavy lift or when extended feed is performed at a high speed, the member to be operated cannot be sufficiently supported, resulting in an unstable feed state. Additionally, since the latter device includes a pair of chains having a control member on a pedestal for a lifting/lowering base on which a loading such as an automobile or the like is placed inside the device, there was a problem that a pedestal side space for the lifting/lowering base cannot be designed in a compact manner.

Accordingly, the problems to be solved by the present invention that is the object of the present invention is to provide a compact lifter device, which can attain a work-piece's lifting/lowering operation in a stable supporting state and can reduce the parts number and an assembly load.

Means for Solving the Problems

First, the invention according to claim 1 solves the above-mentioned problems by a lifter device in which a pair of work-piece lifting chains respectively fed movably forward and backward by a pair of regularly/reversely rotatable driving sprockets while being sandwiched by said sprockets includes flexing suppression members disposed oppositely to each other and said flexing suppression members are engaged with each other so that a work-piece is lifted or lowered in a chain's upright state of the fed chain, characterized in that each of said flexing suppression members comprises a number of blocks disposed at mounting intervals of one to two times the chain pitch on a drawing side of said work-piece lifting/lowering chain and a lifting/lowering support bar of a length corresponding to a chain's upright state, disposed on a feeding side continued to the drawing side of said work-piece lifting/lowering chain.

Second, the lifer device according to claim 2 solves the above-mentioned problems by the facts that, in addition to the configuration of the invention of claim 1, said pair of driving sprockets are oppositely disposed while engagement positions with said pair of work-piece lifting/lowering chains are shifted in a lifting/lowering direction within a range of the chain pitch.

EFFECT OF THE INVENTION

Since the present invention has the above-mentioned configurations the following peculiar effects are obtained.

That is, since in the lifter device according to claim 1 of the present invention, a flexing suppression member comprises a number of blocks disposed at mounting intervals of one to two times the chain pitch on a drawing side of the work-piece lifting/lowering chain and a lifting/lowering support bar of a length corresponding to a chain's upright state, disposed on a feeding side continued to the drawing side of the work-piece lifting/lowering chain, when the work-piece lifting/lowering chains of the lifter device are engaged with a pair of driving sprockets to lift or lower the work-piece, the lifting/lowering support bars of each length corresponding to a work-piece's upright state are disposed oppositely to each other to suppress the flexing of the work-piece lifting/lowering chains. Thus, since a backlash, vibration and flexing in the chain pitch unit are perfectly suppressed even in a case where the work-piece W is a heavy lift or a high speed lifting/lowering is performed, so that stable engagement between the chain and the sprocket can be realized. Thus a compact lifter device, in which lifting/lowering movements of the work-piece are performed in a stable supporting state.

Further, since a feeding or dispensing side continued to a drawing side of the work-piece lifting/lowering chain is formed of a lifting/lowering support bar, the parts number and a load of assembly of the lifter device can be significantly reduced as compared with a case where all work-piece lifting/lowering chains are composed of a number of blocks.

Further, since in the lifter device according to claim 2 of the present invention, a pair of driving sprockets is oppositely disposed while engagement positions with the pair of work-piece lifting/lowering chains are shifted in a lifting/lowering direction within a range of the chain pitch, in addition to the effects exhibited by the invention according to claim 1, when the engagement between the pair of driving sprockets and the work-piece lifting/lowering chains is performed, the work-piece lifting/lowering chains is in an engagement with any one of the driving sprockets and an intermittent chain feed state of a pitch unit, which can be generated by simultaneous disengagement of both driving sprockets is prevented so that a smooth continuous chain feed state is ensured. And even if the diameter of the driving sprocket is small, an engagement ratio is increased by a shifted part of an engagement position between the pair of driving sprockets, so that a disengagement of the chain, a tooth jumping of the sprocket and the like are not generated whereby smooth, stable lifting/lowering movements can be performed.

Further, according to the lifter device of claim 2, the work-piece lifting/lowering chain is engaged with any one of driving sprockets and is not engaged with the sprockets simultaneously. Thus since smaller diameter sprockets can be used, accompanied equipment can be also miniaturized so that the lifter device can be designed in a compact manner. And when the work-piece lifting/lowering chain is accommodated in a flexed state, the flexed state of the work-piece lifting/lowering chain is not constrained to the diameter of the driving sprocket unlike the conventional case. Accordingly, an accommodation space for the work-piece lifting/lowering chain can be decreased and the miniaturization of the lifter device can be further attained synergistically with the use of small driving sprockets.

A better understanding of the invention will be had when reference is made to the Brief Description of the Drawings, Description of the Invention and Claims which follow hereinbelow.

Figure 1:
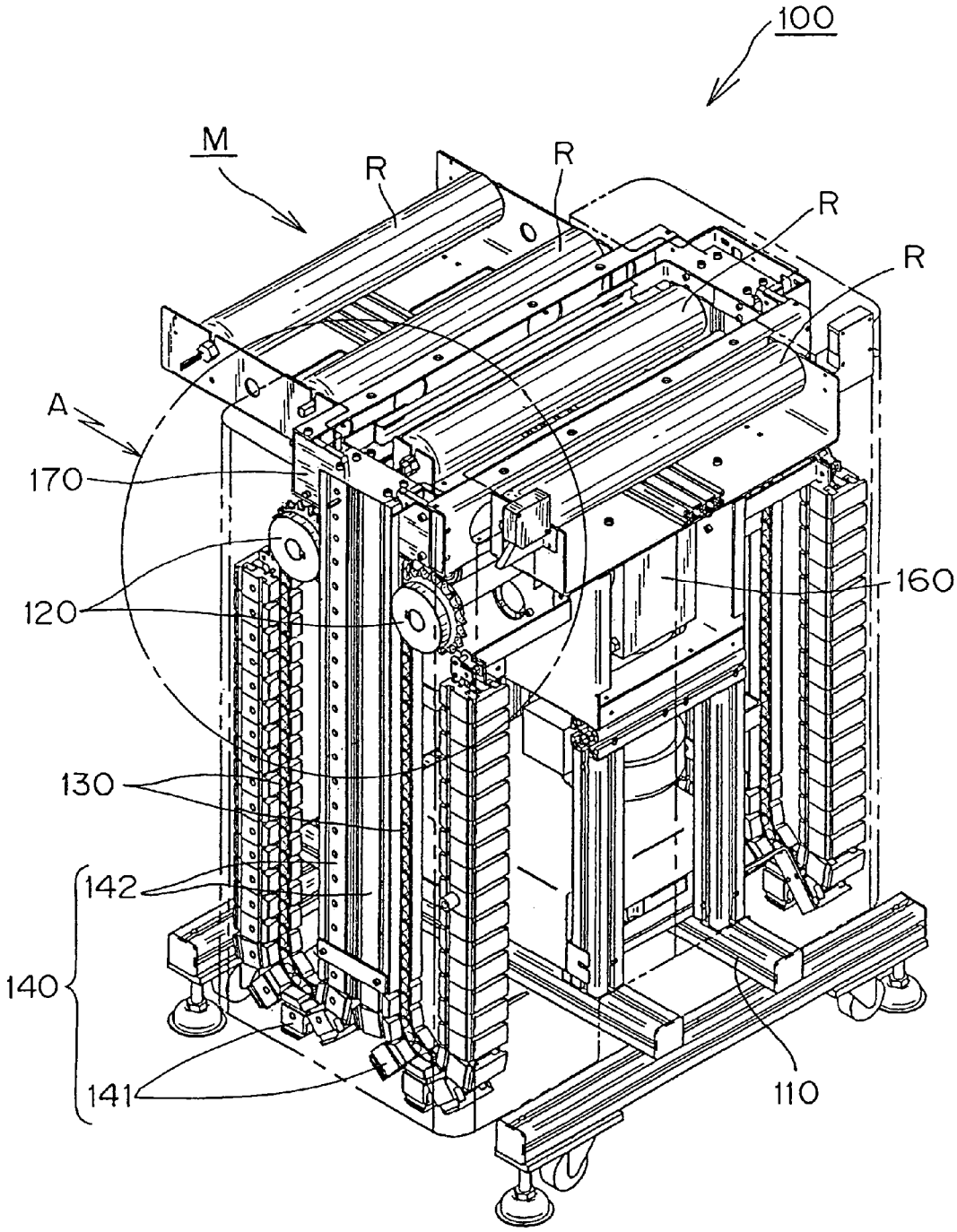
FIG. 1 is a perspective view of a lifter device of an example of the present invention.

A better understanding of the Drawings will be had when reference is made to the Description of the Invention and Claims which follow hereinbelow.

DESCRIPTION OF THE INVENTION

If the lifter device of the present invention is a miniaturized one in which a pair of work-piece lifting chains respectively fed movably forward and backward by a pair of regularly/reversely rotatable driving sprockets while being sandwiched by said sprockets includes flexing suppression members disposed oppositely to each other and the flexing suppression members are engaged with each other so that a work-piece is lifted or lowered in a chain's upright state of the fed chain, is characterized in that the flexing suppression member comprises a number of blocks disposed at mounting intervals of one to two times the chain pitch on a drawing side of the work-piece lifting/lowering chain and a lifting/lowering support bar of a length corresponding to a chain's upright state, disposed on a feeding side continued to the drawing side of the work-piece lifting/lowering chain, whereby work-piece lifting/lowering movements can be attained in a stable supporting state and the parts number and an assembly load can be reduced, any concrete embodiment of the device may be used.

For example, if a work-piece lifting/lowering chain used in a lifter device according to the present invention is engaged with driving sprockets to be able to lift and lower a loading, a block chain in which a block is incorporated into a roller chain through an attachment, and an engagement chain in which a block is incorporated into a chuck type chain through an attachment, and the like may be adopted.

Further, to the lifting/lowering support bar provided in the lifter device of the present invention may be attached a plurality of arm-shaped work-piece supporting members for sequentially supporting work-pieces in a region of at least a length corresponding to a chain's upright state. The set number and set intervals of these arm-shaped work-piece supporting members can be appropriately set in relation to work-pieces reserved on the lifter frame. And a pair of work-piece lifting/lowering chains used in the lifter device of the present invention may support work-pieces in a cantilever state by being arranged on one side of the lifter frame, or it may support the work-pieces in a both-sides supporting state by being arranged on both sides of the lifter frame.

Further, the engagement timing between a pair of driving sprockets and a pair of work-piece lifting/lowering chains may be a simultaneous engagement in which the pair of driving sprockets is arranged at the same level in an engagement position with the pair of lifting/lowering chains. However, when any one of the pair of work-piece lifting/lowering chains is engaged with the pair of driving sprockets during the work-piece lifting or lowering and an intermittent chain feed state of a pitch unit, which can be generated by simultaneous disengagement of both driving sprockets is prevented, so that a smooth continuous chain feed state is ensured by oppositely disposing driving sprockets while engagement positions between the sprockets and the pair of work-piece lifting/lowering chains are shifted in the lifting direction within a range of a chain pitch, even if the diameter of the driving sprocket is small, an engagement ratio is increased by a shifted part of an engagement position between the pair of driving sprockets, so that an disengagement of the chain a tooth jumping of the sprocket and the like are not generated whereby smooth, stable lifting/lowering movements can be performed.

EXAMPLE

An example of a lifter device according to the present invention will be described with reference to FIGS. 1 to 6.

Figure 2:
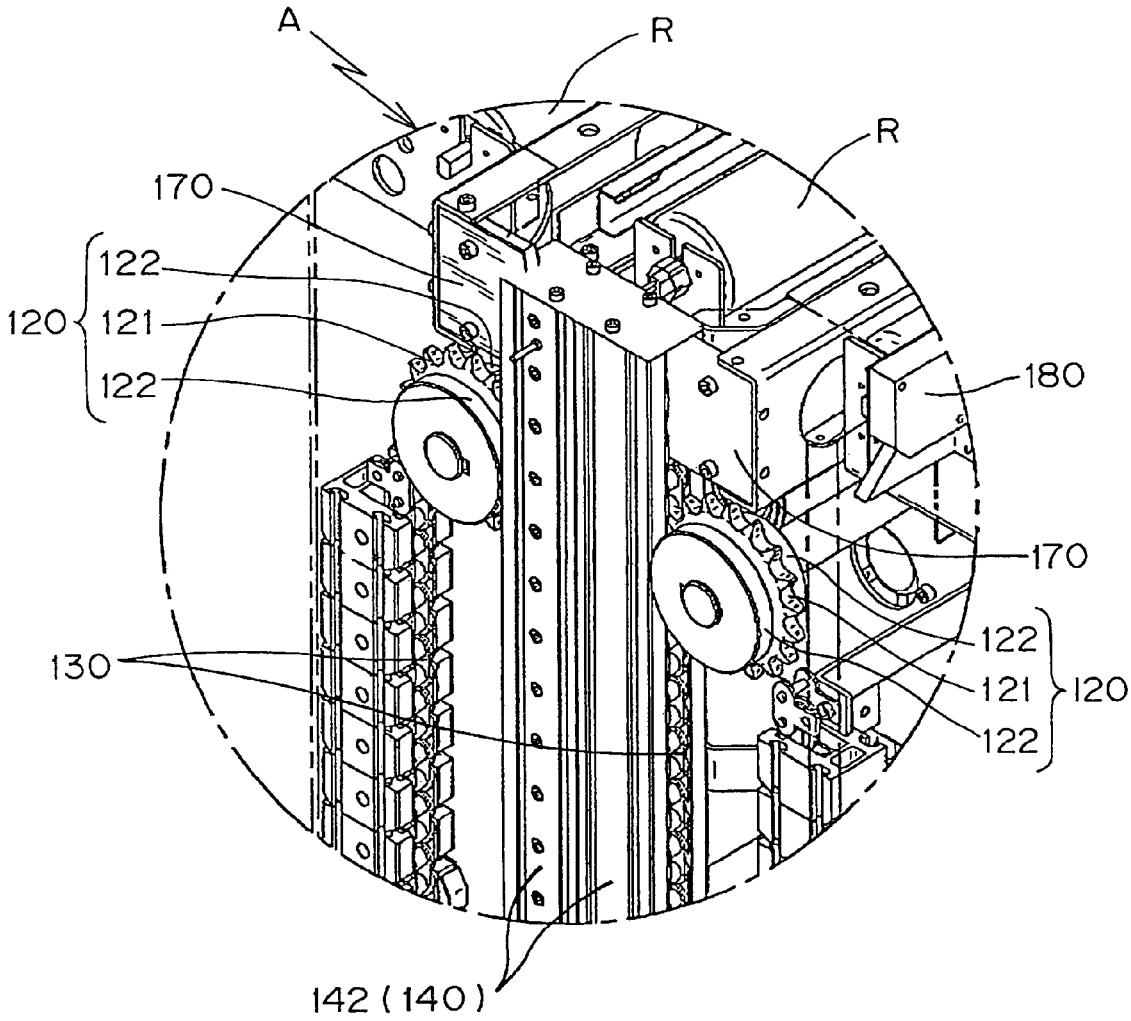
FIG. 2 is an enlarged view of A shown in FIG. 1.
Figure 3:
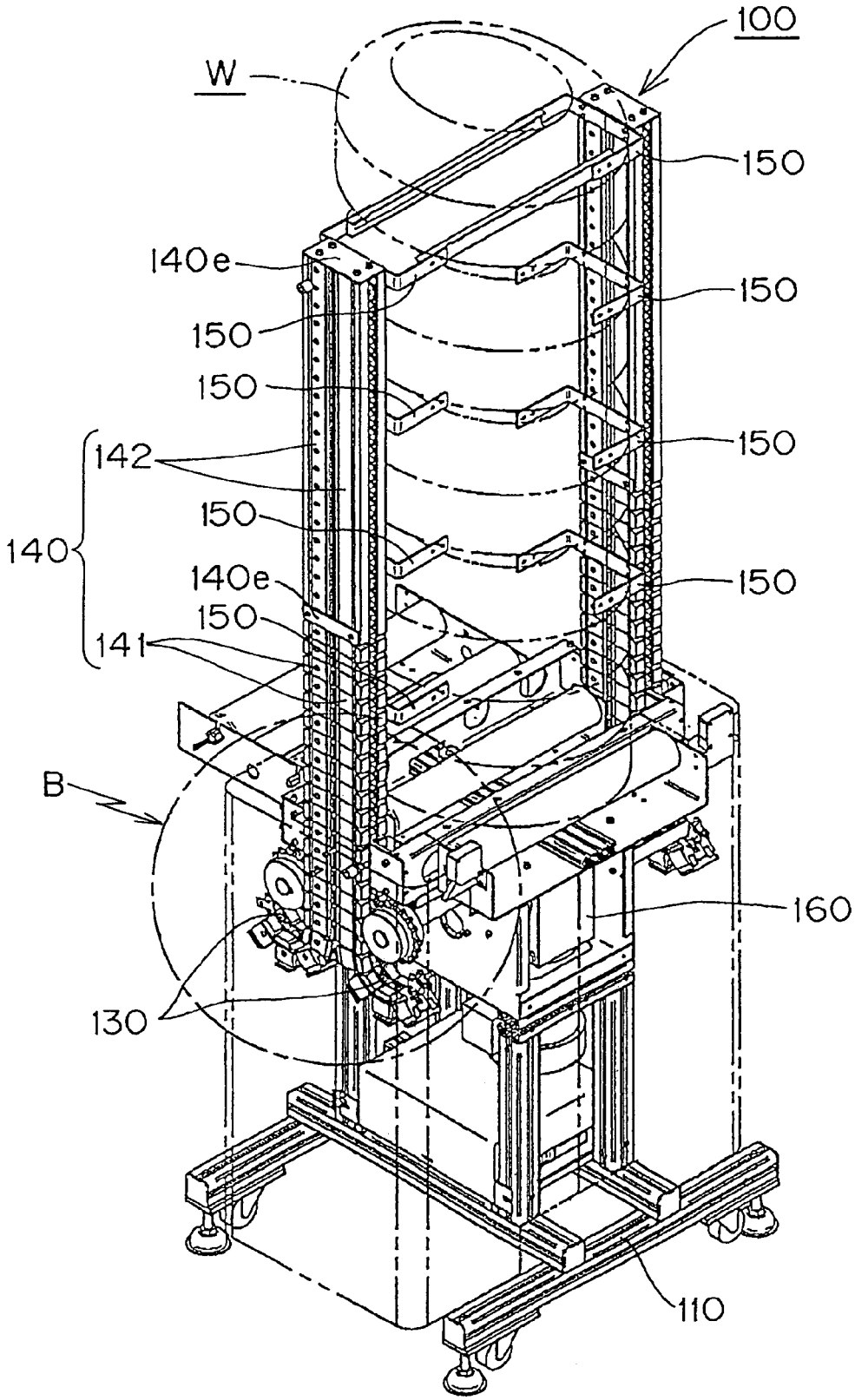
FIG. 3 is a perspective view in a case where the lifter device shown in FIG. 1 was lifted.
Figure 4:
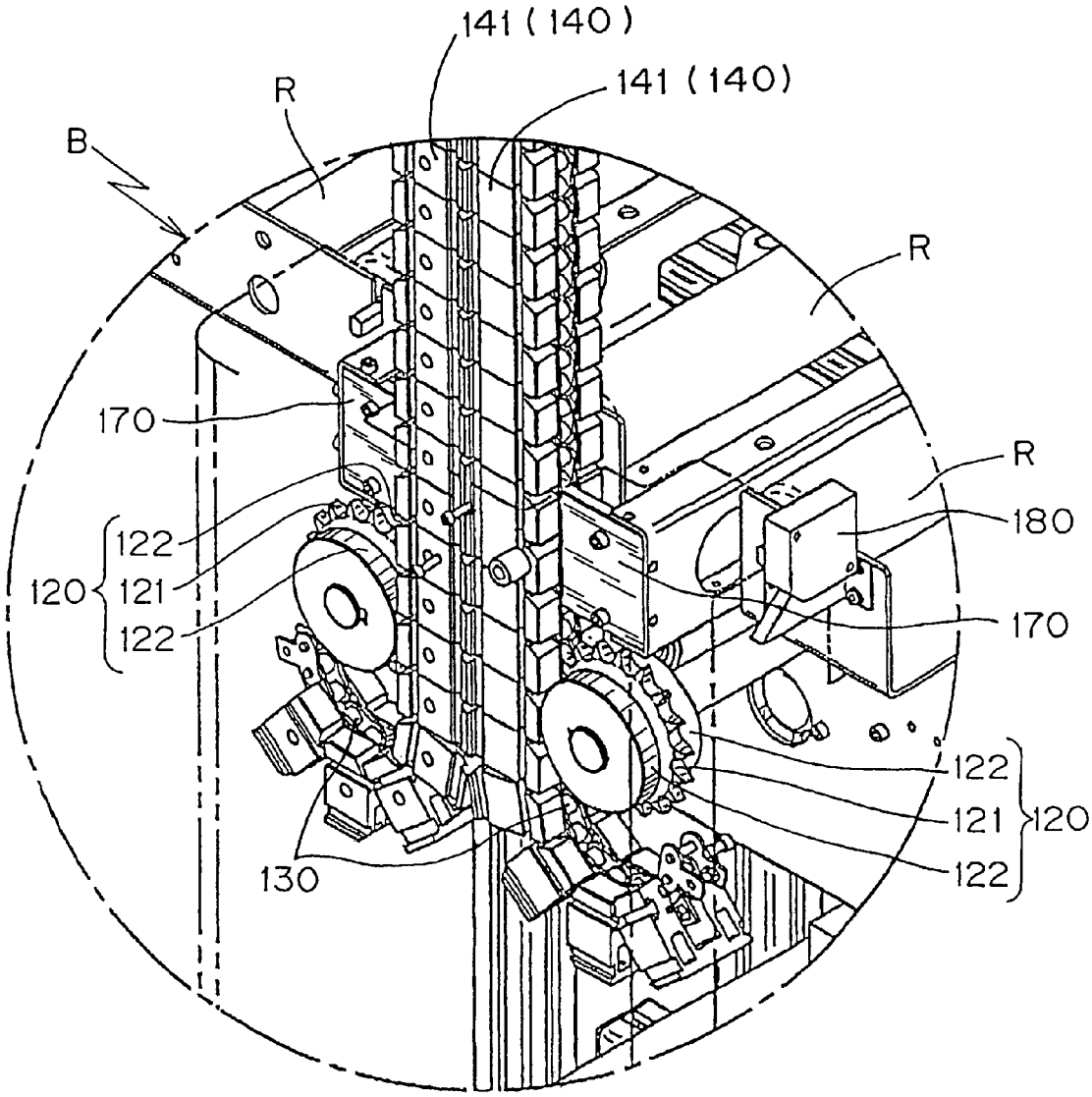
FIG. 4 is an enlarged view of B shown in FIG. 3.
Figure 5:
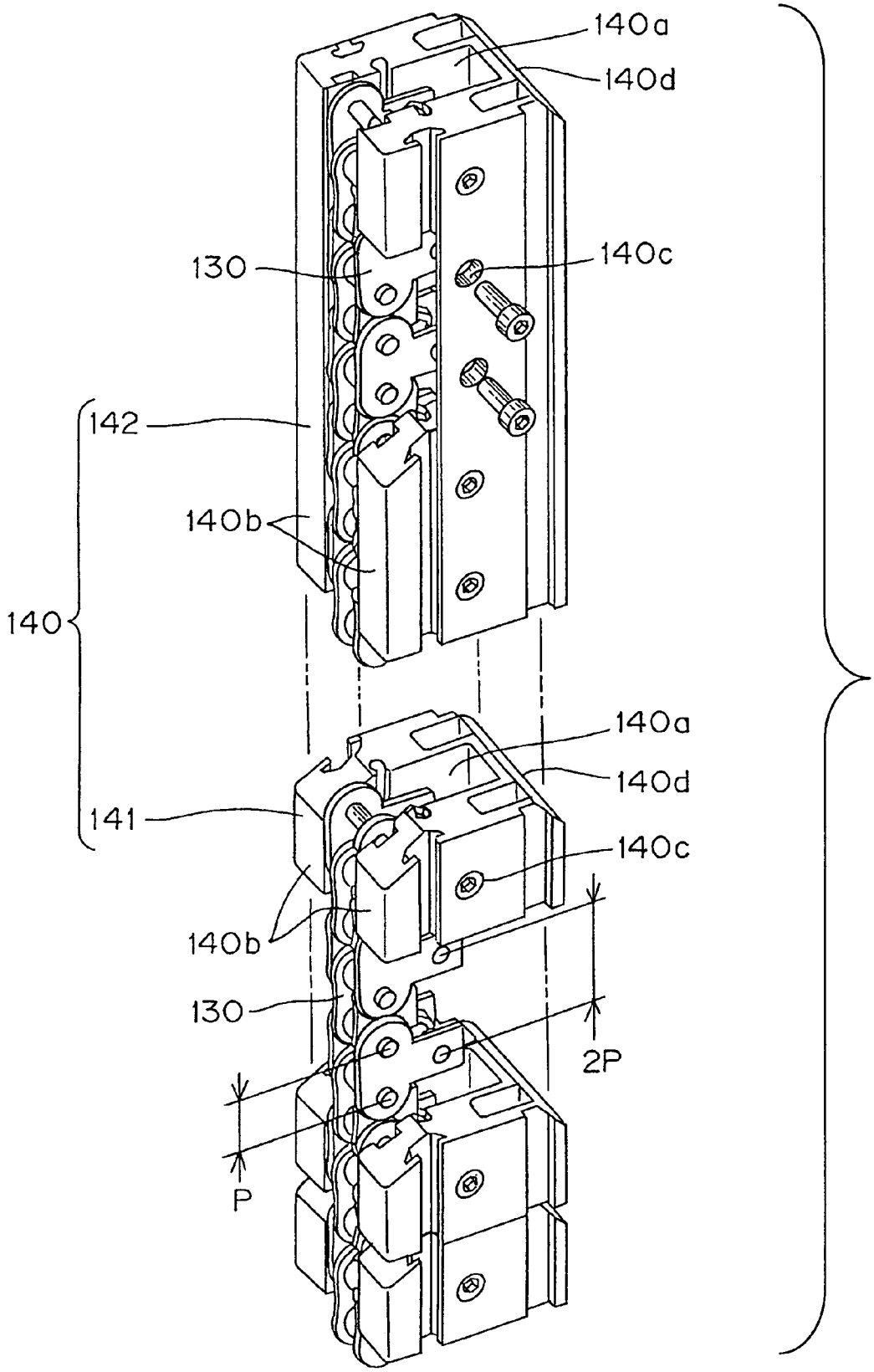
FIG. 5 is an assembly view of a work-piece lifting chain and a flexing suppression member.
Figure 6:
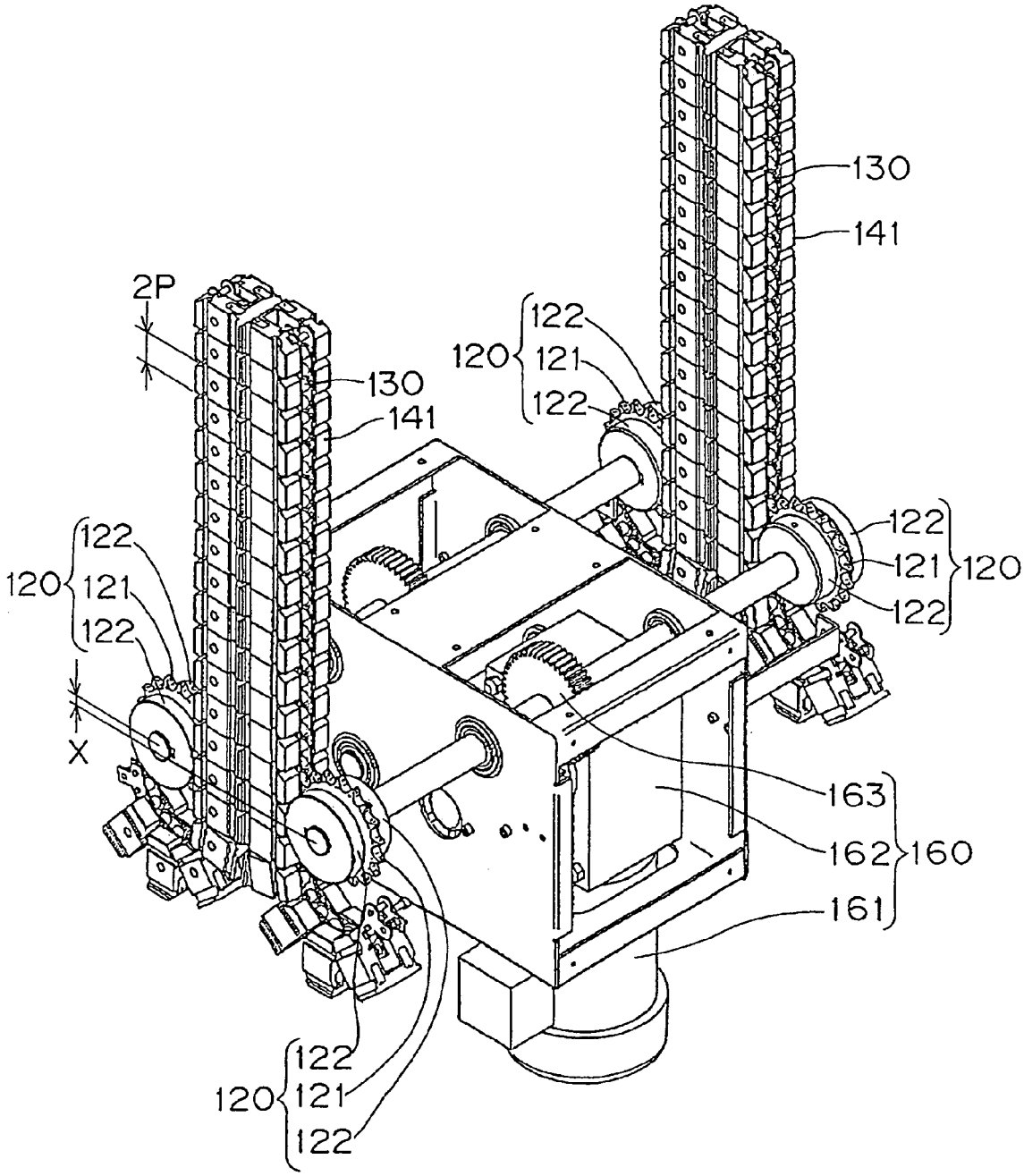
FIG. 6 is a perspective view of a driving unit.

Here, FIG. 1 is a perspective view of a lifter device of an example of the present invention, FIG. 2 is an enlarged view of A shown in FIG. 1, FIG. 3 is a perspective view in a case where the lifter device shown in FIG. 1 was lifted, FIG. 4 is an enlarged view of B shown in FIG. 3, FIG. 5 is an assembly view of a work-piece lifting chain and a flexing suppression member, and FIG. 6 is a perspective view of a driving unit.

First, a lifter device 100, which is one example of the present invention, is incorporated into a conveyor M comprising a plurality of conveying rollers R, which conveys a work-piece W in a horizontal direction as shown in FIGS. 1 to 4, and comprises a pair of regularly/reversely rotatable driving sprockets 120, 120 on both left and right sides of a lifter frame 110 and a pair of work-piece lifting chains 130, 130 respectively fed movably forward and backward by sprocket teeth 121 formed in these driving sprockets 120, 120 in a sandwiched manner by the sprocket teeth 121. The pair of driving sprockets 120, 120 is disposed on one side, and two pairs of the driving sprockets are oppositely disposed on both sides of the lifter frame.

Said pair of work-piece lifting chains 130, 130 respectively include flexing suppression members 140, 140 disposed oppositely to each other. And two pairs of work-piece lifting chains 130, 130 lifts and lowers a work-piece in an upright state of the chains driven by mutual engagement with the flexing suppression members 140, 140.

It is noted that in said pair of work-piece lifting chains 130, 130 trailing side ends are respectively suspended on the lifter frame 110 with mounting fixtures (not shown). Further, the work-piece lifting chain 130 used in the present example is called as a block chain block-incorporated into a general purpose roller chain.

And as shown in FIG. 5, said flexing suppression member 140 comprises a number of blocks 141 disposed on a drawing side of the work-piece lifting chain 130 at mounting intervals which are two times the chain pitch P respectively, and a lifting/lowering support bar 142 of a length corresponding to an upright state of the chain disposed on a driven side, the lifting/lowering support bar 142 being continuous on the drawing side of the work-piece lifting chain 130.

Each of the block 141 and lifting/lowering support bar 142 forming the flexing suppression member 140 exhibits a box-shaped outer appearance with substantially a rectangular cross-section and includes a chain mounting groove 140*a* on a mounting side for the work-piece lifting/lowering chain 130. And in each of the block 141 and lifting/lowering support bar 142, a pair of chain guide contact surfaces 140*b*, 140*b* with which guide rollers 122, 122 coaxially, integrally formed on both surfaces of the above-mentioned driving sprocket 120 slide-contact to guide the work-piece lifting/lowering chain 130 are formed.

It is noted that the reference numeral 140*c* in FIG. 5 denotes a chain mounting pin hole, the reference numeral 140*d* in FIG. 5 denotes an engagement surface, which is oppositely engaged with the other in a chain's upright state, and the reference numeral 140*e* in FIG. 3 denotes a docking fastener for oppositely holding the pair of lifting/lowering support bars 142, 142.

Each of the block 141 and lifting/lowering support bar 142 has the same cross-sectional form while being basically provided with the above-mentioned chain mounting groove 140*a*, the chain guide contact surface 140*b*, the engagement surface 140*d* and the like, and is continuously attached to the drawing side and the feed side of the work-piece lifting/lowering chain 130 so that a chain is fed or dispensed by a pair of driving sprockets 120, 120.

Therefore the block 141 may be separately manufactured from the lifting/lowering support bar 142. However, after a long lifting/lowering support bar 142 obtained by drawing or extrusion was cut by mounting intervals which are respectively twice the chain pitch P, a side of the cut bar to which the work-piece lifting/lowering chain 130 is attached, is partially chamfered so that mutual flexing can be performed on the drawing side of the work-piece lifting/lowering chain 130. Thus parts manufacturing loads for a flexing suppression member 140 can be remarkably reduced.

As shown in FIG. 3, at least a lifting/lowering support bar 142 in the flexing suppression member 140 is provided with a plurality of arm-shaped work-piece supporting members 150 for sequentially supporting a plurality of work-pieces W in each region of a length corresponding to the chain's upright state, and the work-pieces W are stably supported on both sides of the lifter frame 110 in a both-sides supporting state.

It is noted that the set number and set intervals of these arm-shaped work-piece supporting members 150 can be appropriately set in relation to work-pieces reserved on the lifter frame 110.

Further, FIG. 6 shows a driving unit 160, which is disposed inside the lifter frame 110 as mentioned above to transmit power to the driving sprocket 120, which engages with the work-piece lifting/lowering chain 130.

Specifically, the driving unit 160 comprises a regularly/reversely rotatable driving motor 161, which serves as a driving source, a reduction mechanism 162 for power-transmitting an output from this driving motor 161 and a synchronous rotating gear mechanism 163, which synchronously rotating a pair of driving sprockets 120, 120 oppositely to each other, and the like. The pair of sprockets 120, 120 transmits an output from this reduction mechanism 162 to the left and right of the driving unit 160.

In a case of the lifter device 100 of the present example, a pair of driving sprockets 120, 120 is oppositely disposed while engagement positions between the sprockets 120,120 and the pair of work-piece lifting/lowering chains 130, 130 are shifted in the lifting direction within a range of a chain pitch P. When the work-piece lifting/lowering chains 130, 130 are engaged with the pair of driving sprockets 120, 120 during the work-piece lifting or lowering, any one of the work-piece lifting/lowering chains 130, 130 is in an engagement with the driving sprocket 120 and an intermittent chain feed state of a pitch unit P, which can be generated by simultaneous disengagement of both driving sprockets 120, 120 is prevented so that a smooth continuous chain feed state is ensured. And even if the diameter of the driving sprocket is small, an engagement ratio is increased by a shifted part X of an engagement position between the pair of driving sprockets 120, 120, so that an disengagement of the chain, a tooth jumping of the sprocket and the like are not generated whereby smooth, stable lifting/lowering movements can be performed.

Further, in the lifter device 100 of the present example a pair of chain guide plates 170, 170, which contact roller chains forming the pair of work-piece lifting/lowering chains 130, 130 are disposed near the top portion of the above-mentioned pair of driving sprockets 120, 120, so that smooth lifting/lowering movements can be attained.

It is noted that the reference numeral 180 shown in FIGS. 2 and 4 denotes a detection sensor, which detects the lifting/lowering movement of the work-piece lifting/lowering chains 130, and controls ON and OFF of lifting/lowering movement in conjunction with a predetermined operation program.

In the thus obtained lifter device 100 of the present example as shown in FIG. 3, when a pair of driving sprockets 120, 120 is regularly rotated to feed or dispense a pair of work-piece lifting/lowering chains 130,130, a work-piece W can be lifted in a stable chain's upright state by flexing suppression members 140 consisting of lifting/lowering support bars 142 which are respectively sequentially fed while being opposed in a state sandwiched by a pair of driving sprockets 120, 120 and blocks 141 continuous to the lifting/lowering support bars 142, and when the pair of driving sprockets 120, 120 are reversely rotated to draw the pair of work-piece lifting/lowering chains 130, 130, a work-piece W can be lowered in a stable chain's upright state by flexing suppression members 140 consisting of blocks 141 which are respectively sequentially drawn while being opposed in a state sandwiched by the pair of driving sprockets 120, 120 and lifting/lowering support bars 142 continuous to the blocks 141.

At this time, guide rollers 122, 122 integrally formed on both surfaces of the driving sprocket abut on a pair of chain guide contact surfaces 140*b*, 140*b* formed in the flexing suppression member 140 and a pair of chain guide plates 170, 170 abuts on roller chains forming a pair of work-piece lifting/lowering chains 130, 130, so that smooth lifting/lowering movements are exhibited.

Therefore, the lifter device 100 of the present example is incorporated into a conveyor M including a plurality of conveying rollers R, which convey a work-piece W in a horizontal direction. When the work-piece lifting/lowering chains 130, 130 of the lifter device 100 are engaged with a pair of driving sprockets 120,120 to lift the work-piece W, the lifting/lowering support bars 142 of each length corresponding to a work-piece's upright state are disposed oppositely to each other to suppress the flexing of the work-piece lifting/lowering chains 130, 130. Thus, since a backlash, vibration and flexing in the chain pitch unit are perfectly suppressed even in a case where the work-piece W is a heavy lift or a high speed lifting/lowering is performed, so that stable engagement between the chain and the sprocket can be realized. Thus lifting/lowering movements of the work-piece W can be attained by a compact lifter mechanism in a stable supporting state. Further, since a feeding or dispensing side of the chain continued to a drawing side of the work-piece lifting/lowering chain 130 is formed of a lifting/lowering support bar 142, the parts number and a load of assembly of the lifter device can be significantly reduced as compared with a case where all work-piece lifting/lowering chain is composed of a number of blocks 141.

It is noted that although the lifter device 100 was illustrated in a case where the work-piece W is integrally incorporated into the conveyor M including a plurality of conveying rollers R, which conveys the work-piece W in a horizontal direction, if the lifter device 100 is a device necessary for lifting/lowering movements, even any device except for the conveyor M can be incorporated in a compact manner.

Further, a pair of driving sprockets 120, 120 is oppositely disposed while engagement positions between the sprockets 120,120 and the pair of work-piece lifting/lowering chains 130, 130 are shifted in the lifting direction within a range of a chain pitch P. When the engagement between the pair of driving sprockets 120, 120 and the work-piece lifting/lowering chains 130, 130 is performed, the work-piece lifting/lowering chains 130 is in an engagement with any one of the driving sprockets 120 and an intermittent chain feed state of a pitch unit P, which can be generated by simultaneous disengagement of both driving sprockets 120, 120 is prevented so that a smooth continuous chain feed state is ensured. And even if the diameter of the driving sprocket is small, an engagement ratio is increased by a shifted part of an engagement position between the pair of driving sprockets 120, 120, so that a disengagement of the chain a tooth jumping of the sprocket and the like are not generated whereby smooth, stable lifting/lowering movement can be performed. Thus the effects of the present invention are very large.

DESCRIPTION OF REFERENCE NUMERALS

100 . . . Lifter device
110 . . . Lifter frame
120 . . . Driving sprocket
121 . . . Sprocket teeth
122 . . . Guide roller
130 . . . Work-piece lifting/lowering chain
140 . . . Flexing suppression member
140*a* . . . Chain mounting groove
140*b* . . . Chain guide contact surface
140*c* . . . Chain mounting pin hole
140*d* . . . Docking fastener
141 . . . Block
142 . . . Lifting/lowering support bar
150 . . . Arm-shaped work-piece supporting member
160 . . . Driving unit
161 . . . Driving motor
162 . . . Reduction mechanism
163 . . . Synchronous rotating gear mechanism
170 . . . Chain guide plate
180 . . . Detection sensor
W . . . Work-piece
R . . . Conveying roller
M . . . Conveyor
P . . . Chain pitch
X . . . A part of shifted engagement position Those skilled in the art will readily recognize that changes may be made to the invention as set forth herein by way of example without departing from the spirit and the scope of the appended claims.

The invention claimed is:

1. A lifter device comprising a pair of work-piece lifting/lowering chains fed movably forward and backward by a pair of rotatable driving sprockets; each of said chains has a fed chain side and a drawing side; each of said chains includes a pitch; a pair of lifting/lowering bars; said pair of lifting/lowering bars include an arm-shaped work piece supporting member; flexing suppression members disposed generally oppositely to and in engagement with each other; said flexing suppression members engage said lifting/lowering bars raising and lowering said bars; each of said flexing suppression members comprises a number of blocks disposed at mounting intervals of one to two times said chain pitch on said drawing side of said chain; said lifting/lowering bars movable a distance vertically substantially corresponding to said chain's lifting/lowering length; and, said ann-shaped work piece supporting member supports a work piece for raising and lowering said work piece.

2. A lifter device according to claim 1 wherein said pair of driving sprockets are oppositely disposed in engagement with said pair of work-piece lifting/lowering chains which are shifted in a lifting/lowering direction within a range of the chain pitch.

3. A lifter device as claimed in claim 1 further comprising: another pair of work-piece lifting/lowering chains fed movably forward and backward by another pair of rotatable driving sprockets; another pair of lifting/lowering bars; said another pair of lifting/lowering bars include another arm-shaped work piece supporting member; third and fourth flexing suppression members disposed oppositely to and in engagement with each other; said third and fourth flexing suppression members engage said another lifting/lowering bars raising and lowering said bars; and said another arm-shaped work piece supporting member also supports said work pieces for raising and lowering said work pieces.

4. A lifter device as claimed in claim 3 wherein said blocks are attached to said chains.

5. A lifter device as claimed in claim 1 wherein said blocks are attached to said chains.

* * * * *

UNITED STATES PATENT AND TRADEMARK OFFICE

CERTIFICATE OF CORRECTION

PATENT NO. : 7,237,654 B2
APPLICATION NO. : 11/374543
DATED : July 3, 2007
INVENTOR(S) : Shunji Sakura et al.

It is certified that error appears in the above-identified patent and that said Letters Patent is hereby corrected as shown below:

Column 8, line 42, delete “ann” and insert --arm-- before “-shaped”.

Signed and Sealed this

Twenty-first Day of August, 2007

JON W. DUDAS
*Director of the United States Patent and Trademark Office*